United States Patent [19]

Fultz et al.

[11] Patent Number: 4,930,681

[45] Date of Patent: Jun. 5, 1990

[54] AUTOMATIC LATCHING CONTAINER HAVING GOOD THERMAL INSULATION

[76] Inventors: Clinton Fultz, 5317 O'Neall Rd., Waynesville, Ohio 45068; Stanley Dalton, 10190 Mudlick Rd., Germantown, Ohio 45327

[21] Appl. No.: 233,224

[22] Filed: Aug. 18, 1988

[51] Int. Cl.[5] ..... B65D 5/20

[52] U.S. Cl. ..... 229/114; 229/125.27; 229/125.29; 229/146; 229/148; 229/906; 229/DIG. 2; 229/DIG. 5; 493/80; 493/137; 493/139; 493/140

[58] Field of Search ..... 220/4 B; 229/113, 114, 229/125, 27, 125.29, 145, 146, 148, 169, 178, 902, 906, DIG. 2, DIG. 5, DIG. 4; D9/423, 431, 433; 493/79, 80, 137, 139, 140, 168

[56] References Cited

U.S. PATENT DOCUMENTS

| | | | |
|---|---|---|---|
| D. 241,821 | 10/1976 | Jewell | D9/423 |
| D. 244,833 | 6/1977 | Persson | D9/423 |
| 2,683,561 | 7/1954 | Rice | 229/125.29 |
| 2,711,282 | 6/1955 | D'Esposito | 229/125.29 |
| 2,765,973 | 10/1956 | Goldstein | 229/DIG. 4 |
| 2,839,236 | 6/1958 | Dunning | 229/148 |
| 3,385,424 | 5/1968 | Thompson et al. | 229/DIG. 2 |
| 4,232,816 | 11/1980 | Johnson et al. | 229/114 |
| 4,240,576 | 12/1980 | Persson | 229/148 |
| 4,266,713 | 5/1981 | Maroszek | 229/114 |
| 4,289,491 | 9/1981 | Collura | 229/146 |
| 4,470,538 | 9/1984 | Heathcock et al. | 229/125.29 |
| 4,648,549 | 3/1987 | Trutna | 229/143 |
| 4,655,366 | 4/1987 | Sykes | 220/441 |
| 4,655,386 | 4/1987 | Billberg | 229/3.1 |
| 4,662,559 | 5/1987 | Urya | 229/131 |
| 4,676,428 | 6/1987 | McClure | 229/16 R |
| 4,676,430 | 6/1987 | Wischusen, III et al. | 229/140 |
| 4,679,726 | 7/1987 | Oliff | 229/138 |
| 4,684,058 | 8/1987 | Weber | 206/604 |
| 4,688,673 | 8/1987 | Yabe | 206/387 |
| 4,688,675 | 8/1987 | Miller et al. | 206/508 |
| 4,712,728 | 12/1987 | Schuster | 229/52 B |
| 4,744,507 | 5/1988 | Morsbach | 229/40 |
| 4,763,832 | 8/1988 | Forbes, Jr. | 229/114 |

OTHER PUBLICATIONS

*Distribution Packaging* by Friedman & Kipnees, published by Robert E. Krieger Publishing Co., 1977, pp. 68 to 69.

*Primary Examiner*—Gary Elkins
*Attorney, Agent, or Firm*—Jacox & Meckstroth

[57] ABSTRACT

A container which can be constructed in one-piece or in two pieces. The container is preferably of corrugated paper-like material and is preferably of the "E-flute" type of corrugated material. The container includes a body member or body portion and a cover member or cover portion. The container includes a latch which automatically operates to latch the container in closed condition when the container is closed. The container has panels and walls which are relatively angular so that the opposing walls are in effective covering relationship when the container is closed. Also, the angular relationship between the panels and the walls permits a plurality of the containers to be nested and stacked in a stack having a minimum height.

7 Claims, 5 Drawing Sheets

120
124
126
128
130
132
136
138
139
140
142
146
150
152
156
158
160
162
166
168
170
176
180
12
13

AUTOMATIC LATCHING CONTAINER HAVING GOOD THERMAL INSULATION

BACKGROUND OF THE INVENTION

In the fast food business, as well as in numerous other types of businesses, it is desirable to have an attractive container in which to provide products to customers. It is also important to have such a container which is easily and readily assembled. It is also desirable to have such a container which latches automatically and securely when the container is closed. It is also desirable to have such a container which is light in weight. It is also desirable to have such a container which can be efficiently stacked or nested in quantities. It is also desirable, particularly in the fast food business, to have a container which has good thermal insulation qualities. It is also desirable to provide such a container which can be rapidly and effectively produced by simplified mechanisms.

It is therefore an object of this invention to provide a container which has the characteristics set forth above.

Another object of this invention is to create such a container which may be constructed of corrugated "E-flute" material, so that the container has greater strength, less warpage, more consistent shape, and has better thermal insulation capability than flat solid sheet material.

Other objects and advantages of this invention reside in the construction of parts, the combination thereof, the method of production and the mode of use, as will become more apparent from the following description.

The following United States Patents contain disclosures of various cartons and containers. However, none of these patents discloses the structure or method of this invention: U.S. Pat. Nos. 4,648,549, 4,655,366, 4,655,386, 4,662,559, 4,676,428, 4,676,430, 4,679,726, 4,684,058, 4,688,673, 4,688,675, 4,712,728, 4,744,507.

SUMMARY OF THE INVENTION

This invention pertains to a container for articles. The invention pertains particularly to a container for use in the fast food industry. The container is preferably constructed of corrugated material of a type known as E-flute size corrugated material, which has excellent thermal insulation characteristics, even though the container has relatively thin wall dimensions. The container is thus constructed of material which is light in weight in consideration of its physical dimensions. The angular relationship between the panels and walls of the container is such that complementary walls of the container effective close the container when the container is in its closed condition. The angular relationship between the panels and the walls of the container is also such that a plurality of the containers can be easily and effectively nested and stacked, and in which the height of the stack is minimal.

The container of this invention is formed from a blank and comprises an upper panel and a lower panel. Each panel has wall portions integral therewith. Between the panels and the wall portions crease lines are provided, so that the wall portions can be readily positioned at angles with respect to the panels.

Complementary wall portions include latch means which automatically function to lock the container in closed position when the container is closed.

The container can be constructed in one piece or in two pieces.

DETAILED DESCRIPTION OF THE INVENTION

Figure 1:
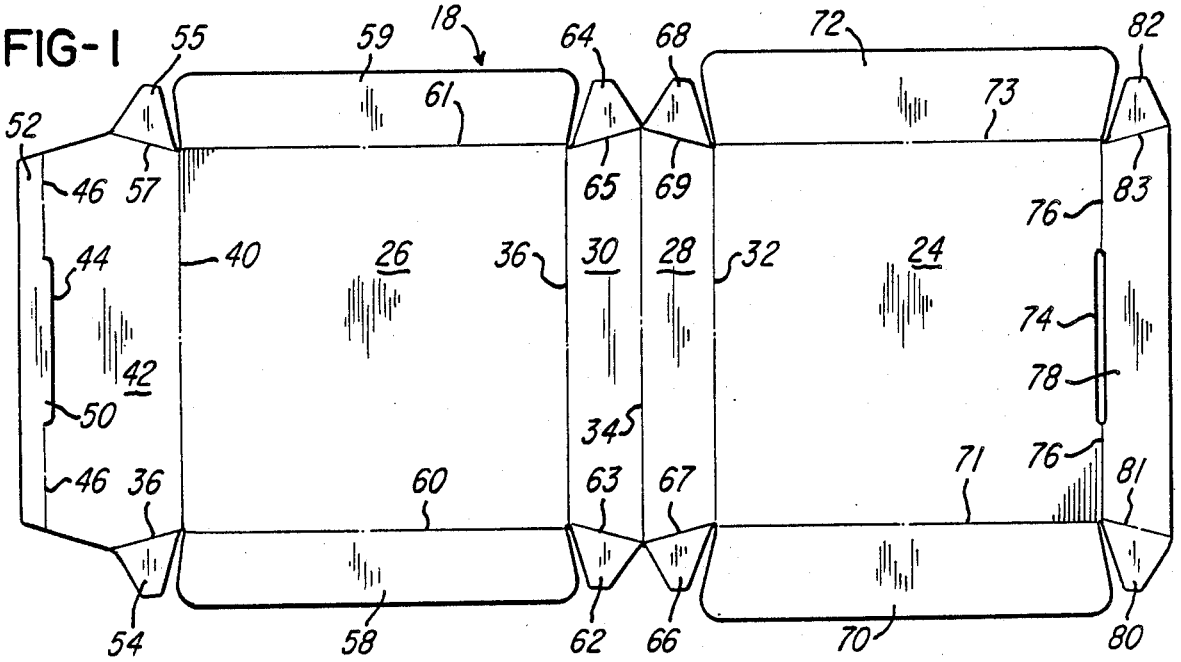
FIG. 1 is a layout type of view, showing a sheet of material or blank formed for constructing a container but prior to folding and attaching together portions of the sheet to produce a one-piece container of this invention.

FIGS. 1–8 show a one-piece container or carton 20 of this invention. FIG. 1 shows a sheet of material or blank 18 with portions formed for folding and for mutual attachment to form the one piece container or carton 20. The blank or sheet 18 comprises an upper panel 24 and a lower panel 26. Joining the upper panel 24 to the lower panel 26 are a connector wall 28 and a connector wall 30. The connector wall 28 is separated from the upper panel 24 by a crease line 32. The connector wall 28 is separated from the wall 30 by a hinge line 34. The connector wall 30 is separated from the lower panel 26 by a crease line 36.

Joined to the lower panel 26 by means of a crease line 40 is a wall 42. The wall 42 has a U-shape slit 44 from which a pair of opposed crease lines 46 extend. The U-shape slit 44 and the crease lines 46 form a latch 50, which is an integral part of a flap 52. The U-shape slit 44 and the crease lines 46 separate the flap 52 from the wall 42.

Extending laterally from opposite parts of the wall 42 are tabs 54 and 55, which are separated from the wall 42 by crease lines 56 and 57, respectively.

Extending from the lower panel 26 are a wall 58 and a wall 59, which are separated from the lower panel 26 by crease lines 60 and 61, respectively.

Extending laterally from the wall 30 are tabs 62 and 64 which are separated from the wall 30 by crease lines 63 and 65. Extending laterally from the wall 28 are tabs 66 and 68 which are separated from the wall 28 by crease lines 67 and 69.

Attached to the upper panel 24, by means of crease lines 71 and 73, respectively, are walls 70 and 72.

At the edge of the upper panel 24, and between the upper panel 24 and a wall 78, is a slot 74. At opposed ends of the slot 74 are crease lines 76. The slot 74 and the crease lines 76 separate the upper panel 24 from the wall 78. At opposed ends of the wall 78 are tabs 80 and 82, which are separated from the wall 78 by crease lines 81 and 83, respectively.

The blank 18 is preferably of corrugated paper or paper-like material or the like. Preferably, the blank 18 is of a material referred to as "E-flute" corrugated material, which has a thickness of about one-sixteenth of an inch. The corrugations or flutes are best shown in FIGS. 1–7 as extending longitudinally through the blank 18, through the flap 52 and from the flap 52, to the wall 78, and through the wall 78. Therefore, in this arrangement of the flutes or corrugations, each crease can be accurately positioned in the location desired in the blank 18. Furthermore, in this arrangement of the flutes or corrugations most of the creases are normal to the flutes or corrugations. Creases in the blank 18 which are normal to the flutes or corrugations are stronger creases than creases which are parallel to the flutes or corrugations.

Figure 2:
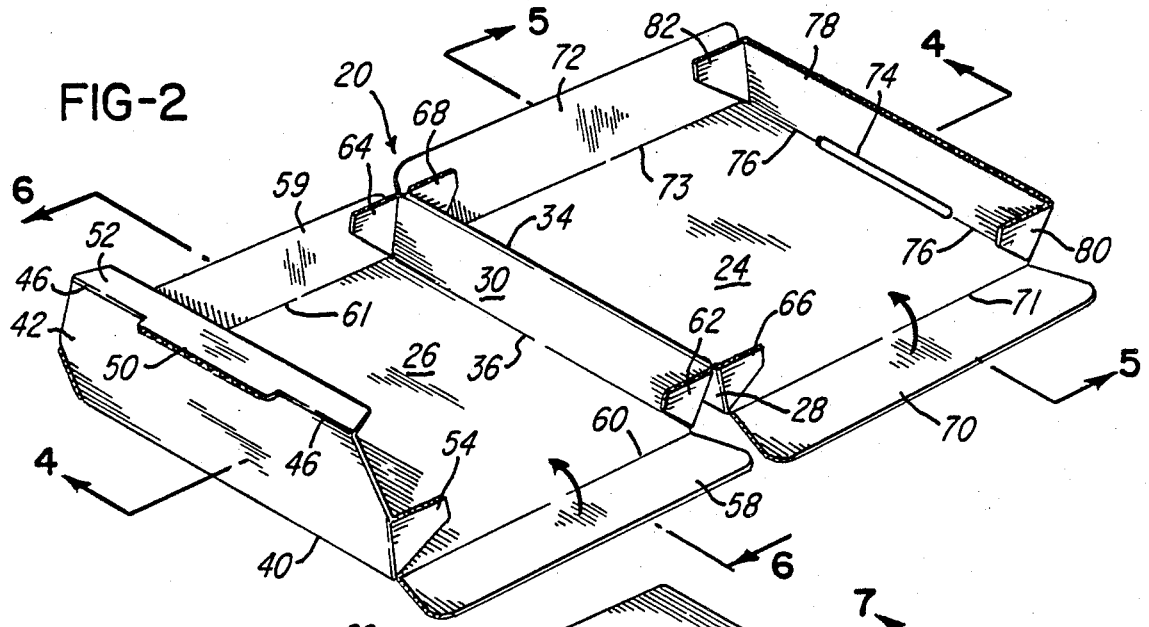
FIG. 2 is a perspective view, drawn on substantially the same scale as FIG. 1, and illustrating steps in folding portions of the sheet in the formation of a container.

In forming the carton or container 20, parts of the blank 18 are folded and attached together. As illustrated in FIG. 2, the wall 78 is folded along the crease lines 76, and the walls 70 and 72 are folded along the crease lines 71 and 73, respectively. The tabs 80 and 82 are attached to the walls 70 and 72, respectively.

The connector walls 28 and 30 are folded along the hinge line 34. Thus, the connector walls 28 and 30 are angularly positioned, one with respect to the other. The connector walls 28 and 30 are also folded along the crease lines 32 and 36, respectively. Thus, the connector walls 28 and 30 are angularly positioned with respect to the upper panel 24 and the lower panel 26.

During construction of the container 20, the tab 68 is attached to the wall 72. The tab 66 is attached to the wall 70. The wall 59 is folded along the crease line 61. The wall 58 is folded along the crease line 60. The tab 64 is attached to the wall 59. The tab 62 is attached to the wall 58.

Figure 4:
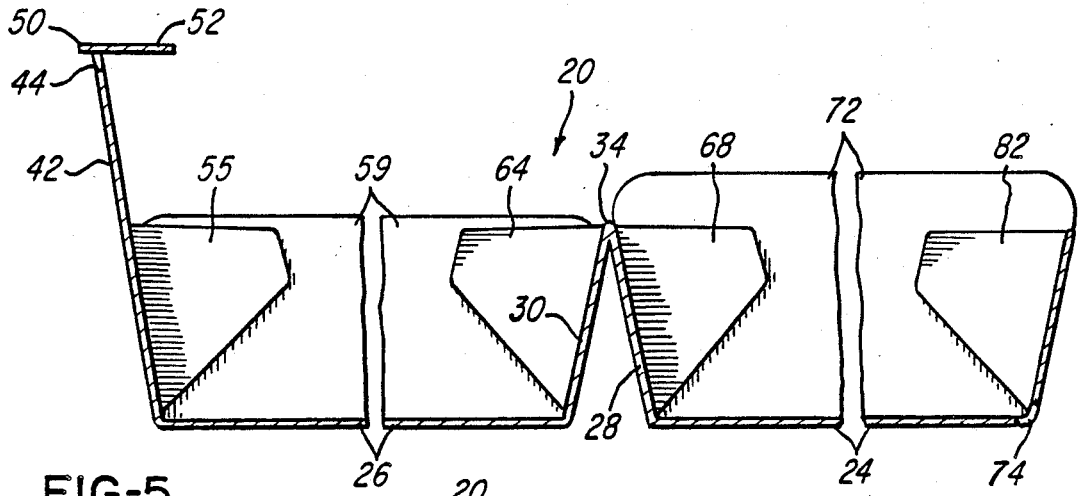
FIG. 4 is an enlarged sectional view, with parts broken away and shown in section, and taken substantially on line 4—4 of FIG. 2.
Figure 5:
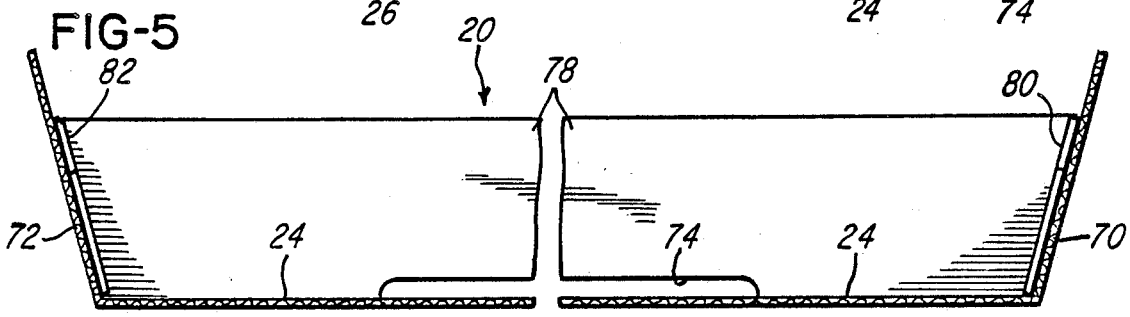
FIG. 5 is an enlarged sectional view, with parts broken away and shown in section, drawn on substantially the same scale as FIG. 4, and taken substantially on line 5—5 of FIG. 2.
Figure 6:
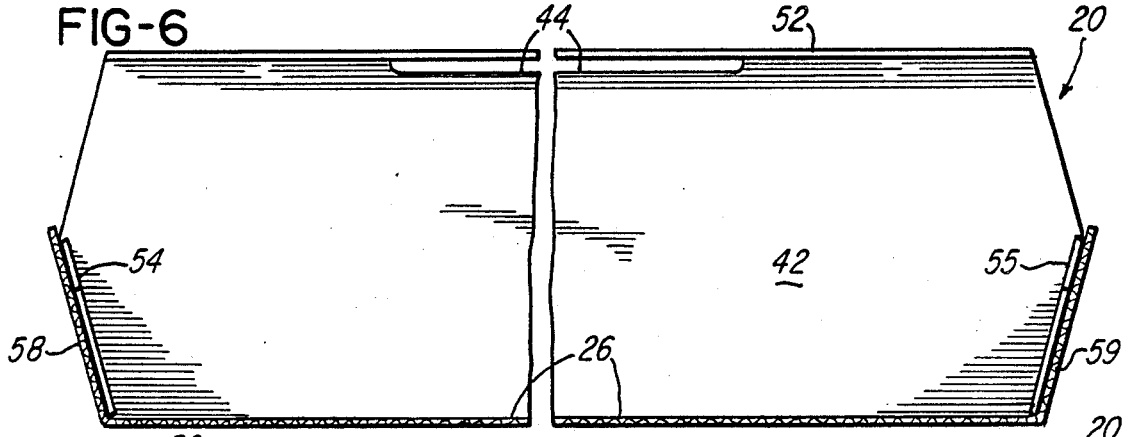
FIG. 6 is an enlarged sectional view, with parts broken away and shown in section, drawn on substantially the same scale as FIGS. 4 and 5, and taken substantially on line 6—6 of FIG. 2.

The wall 42 is folded along the crease line 40. The tab 55 is attached to the wall 59. The tab 54 is attached to the wall 58. The flap 52 is folded along the crease lines 46, so that the latch 50 extends angularly from the wall 42, as illustrated in FIGS. 2 and 4.

The attachments of the tabs to the walls as described above are preferably made by suitable adhesive means.

Thus, the lower panel 26 and the parts attached thereto form a body portion of the container 20, and the upper panel 24 and the parts attached thereto form a cover portion of the container 20.

Figure 3:
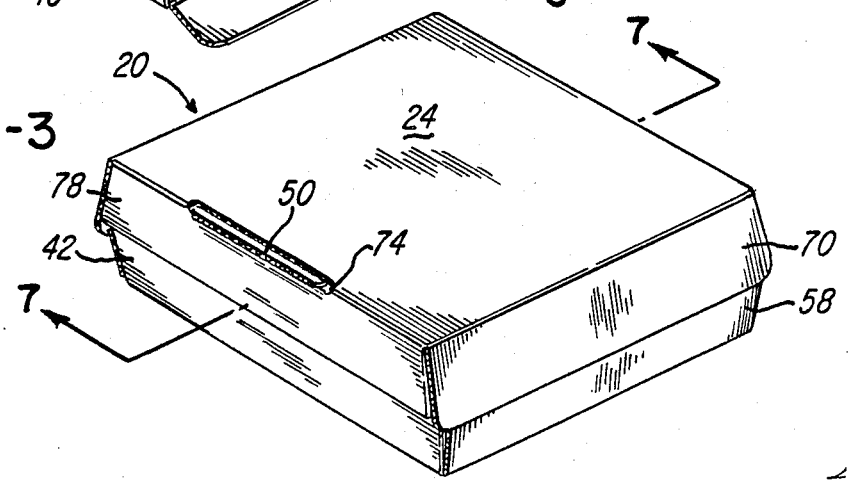
FIG. 3 is a perspective view, drawn on substantially the same scale as FIGS. 1 and 2, and showing a container of this invention formed from a sheet of material with the container in a closed condition.
Figure 7:
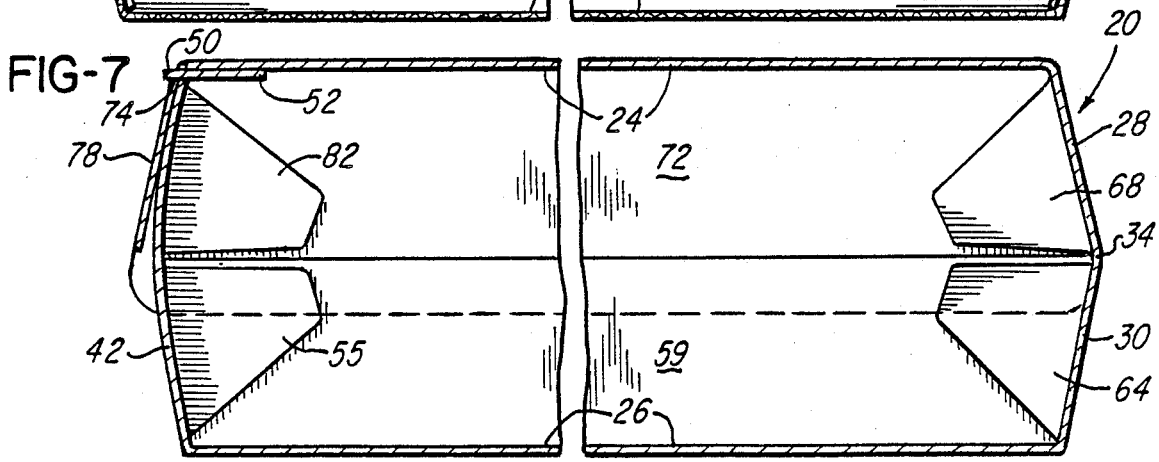
FIG. 7 is a sectional view, with parts broken away and shown in section, drawn on substantially the same scale of FIGS. 4, 5, 6, and taken substantially on line 7—7 of FIG. 3.

To close the container 20, to the condition shown in FIG. 3, the upper panel 24 and the parts attached thereto are pivotally moved about the hinge line 34. When the upper panel 24 is substantially parallel with the lower panel 26, the wall 78 partially covers the wall 42. As the wall 78 moves toward the flap 52 and engages the flap 52, the flap 52 pivotally moves about the crease lines 46. Thus, the latch 50 automatically moves into the slot 74, and the container 20 is automatically latched in a closed condition when the container 20 is closed, as shown in FIG. 7. When container 20 is closed, as shown in FIG. 7, the upper panel 24 is substantially parallel to the lower panel 26. In this position the latch 50 is within the slot 74 and the flap 52 engages the upper panel 24 as best shown in FIG. 7. Thus, the latch 50 is firmly retained by the upper panel 24 within the slot 74 and the container 20 is firmly retained in a closed position. Thus, it is understood that latching of the upper panel 24 to the lower panel 26 is automatic as the upper panel 24 is brought into parallel relationship with the lower panel 26.

When it is desired to open the container 20, the wall 42 is forced inwardly. Thus the latch 50 is removed from the slot 74, and the upper panel 24 can be pivotally moved away from the lower panel 26.

A container 20 of this invention is preferably constructed of thin corrugated paper-like material, and has excellent thermal insulation qualities. When a container 20 of this invention is constructed of E-flute corrugated material, the container 20 is extremely light in weight, in consideration of its physical dimensions, while also being strong, sturdy, and durable.

Figure 8:
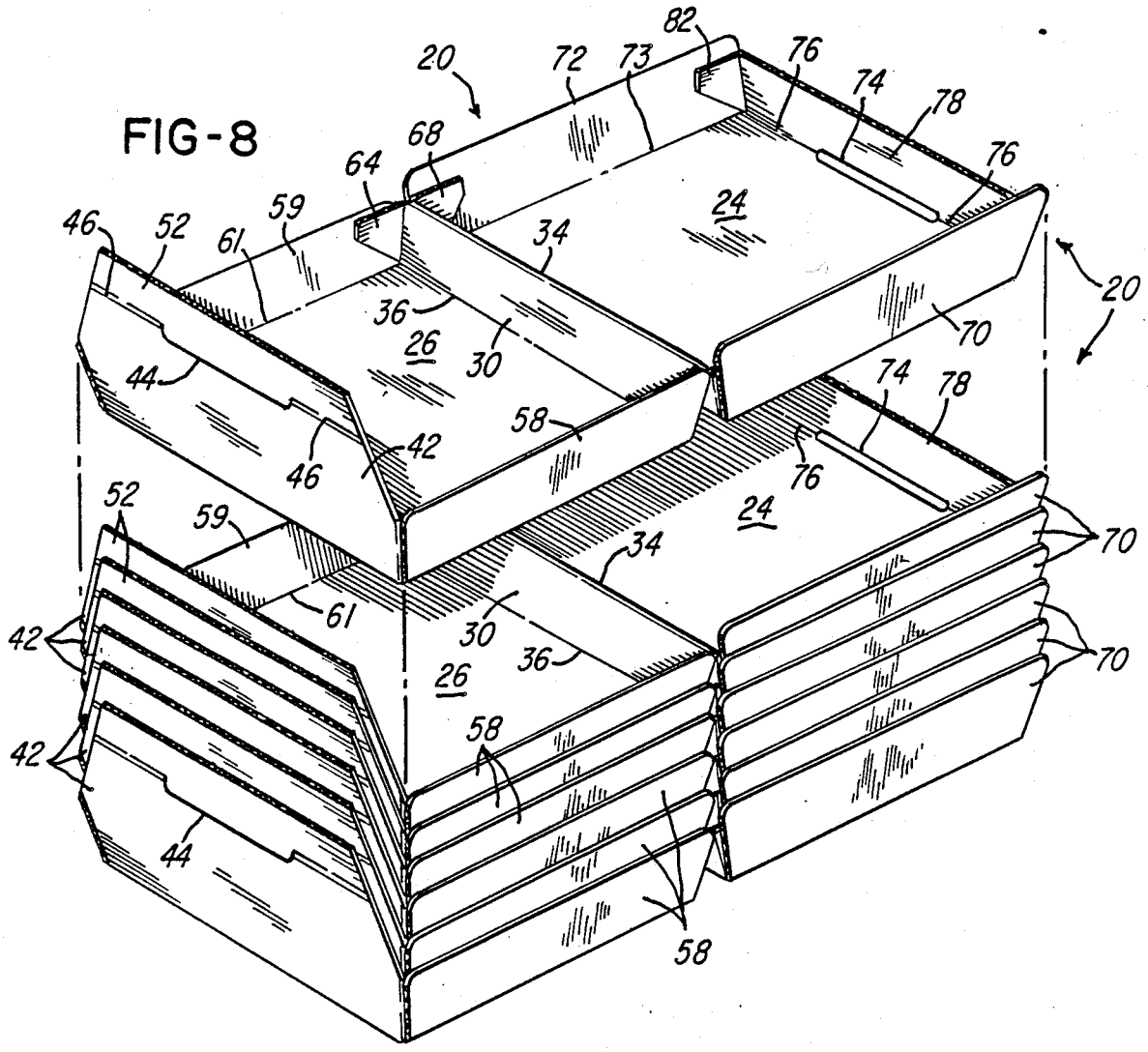
FIG. 8 is a perspective view drawn on substantially the same scale as FIGS. 1–3, and illustrating a plurality of containers of this invention in an open condition and stacked or nested.

As shown in FIG. 1, each of the tabs 82, 68, 64, 55, 54, 62, 66, and 80 is separated from its respective wall by a crease line which is angular with respect to the wall to which the tab is attached. Thus, when the tabs are attached to adjoining walls, with the crease lines in alignment with the edges of the adjoining walls, as shown in FIGS. 2–7, the walls 72, 78, 70 are slightly angular with respect to the upper panel 24, and the walls 59, 42, and 58 are slightly angular with respect to the lower panel 26. The wall 30 is slightly angular with respect to the lower panel 26, and the wall 28 is slightly angular with respect to the upper panel 24. The angular relationship between the walls and the panels is preferably in the order of 98 to 108 degrees. As shown in FIGS. 3 and 7, as a result of this angular relationship, when the container 20 is closed, the walls 78, 70, and 72 substantially cover the walls 42, 58 and 59 which are attached to the lower panel 26. Thus, there is good coverage of walls 78, 70, and 72 over the walls 42, 58, and 59 to effectively close the container 20. Also, as a result of the angular relationship, a plurality of containers 20 is easily and readily stacked, as illustrated in FIG. 8, and when stacked, the containers 20 create a minimum height condition.

FIGS. 9–14

FIGS. 9–14 pertain to a container 120 of this invention which is constructed in two pieces, an upper piece 124 and a lower piece 126.

The lower piece 126 includes a lower panel 128 and side walls 130 and 132. The side walls 130 and 132 are substantially identical. The lower piece 126 also includes end walls 136 and 138. The end walls 136 and 138 are substantially identical.

The lower piece 126 is constructed from a blank in a manner similar to the construction of the container 20. The side walls 130 and 132 and the end walls 136 and 138 are folded with respect to the lower panel 128. The side walls 130 and 132 are attached to the end walls 136 and 138 by means of tabs 139, which extend from the end walls 136 and 138. Extending upwardly from the end wall 136 is a flap 140, which is separated from the end wall 136 by a pair of spaced-apart crease lines 142. The crease lines 142 are separated by a latch 146, which is cut from the end wall 136. The flap 140 and the latch 146 are similar to the flap 52 and the latch 50 of the container 20 of FIGS. 1–8.

Extending upwardly from the end wall 138 is a flap 150, which is separated from the end wall 138 by a pair of spaced-apart crease lines 152. The crease lines 152 are separated by a latch 156 which is cut from the end wall 138. The flap 150 and the latch 156 are similar to the flap 140 and the latch 146 of the end wall 136.

The upper piece 124 is also constructed in a manner somewhat similar to that of the container 20. The upper piece 124 includes an upper panel 158. The upper piece 124 includes side walls 160 and 162, which are folded with respect to the upper panel 158. The upper piece 124 also includes end walls 166 and 168, which are folded with respect to the upper panel 158. The side walls 160 and 162 are attached to the end walls 166 and 168 by tabs 170, which extend from the end walls 166 and 168.

The end walls 166 and 168 are separated from the upper panel 158 by spaced-apart crease lines 176. The crease lines 176 are separated by a slot 180.

Figures 9, 10, 11, 14:
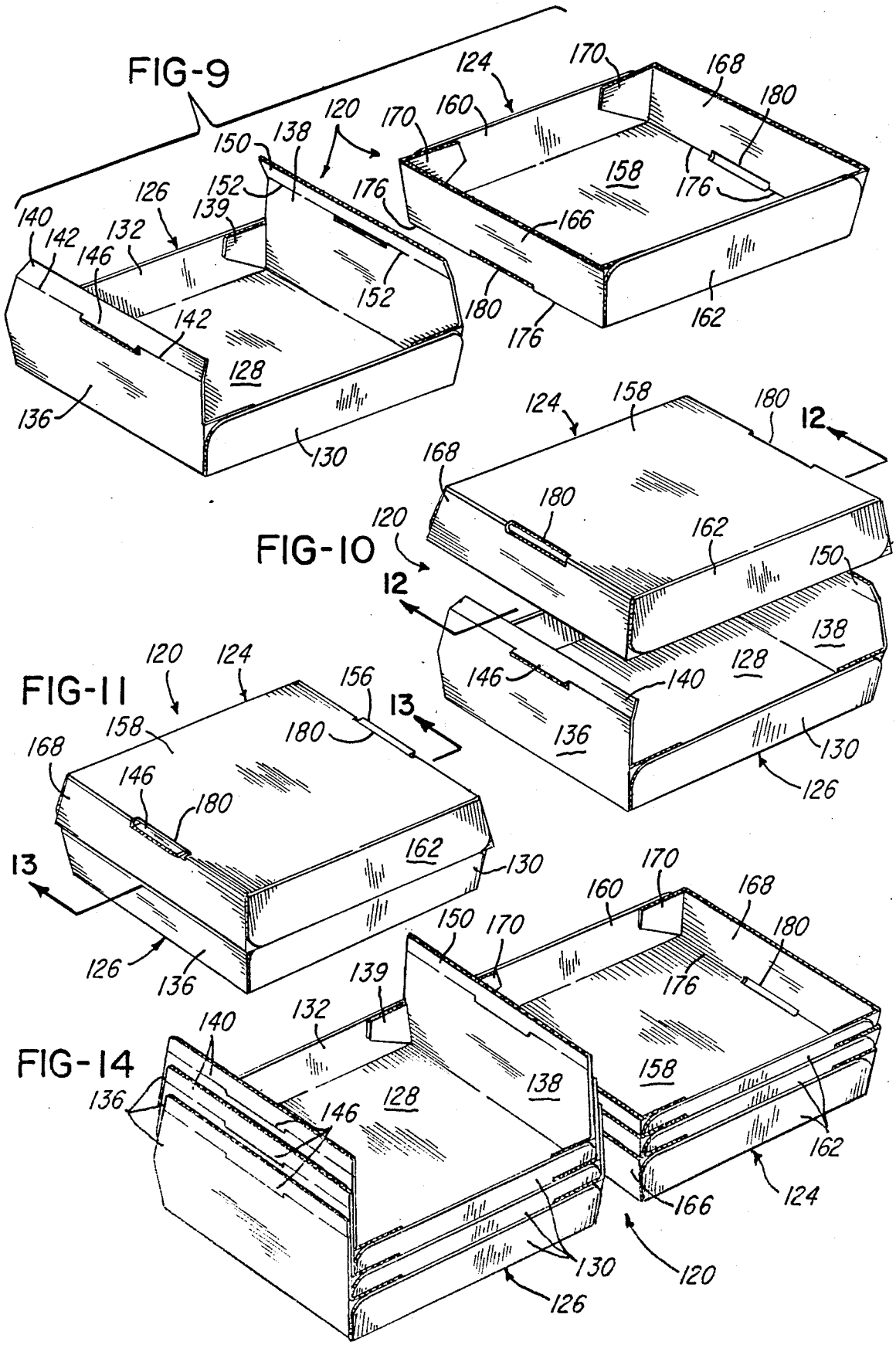
FIG. 9 is a perspective view illustrating a two-piece container of this invention. This view is drawn substantially on the same scale as FIGS. 1–3.
FIG. 10 is a perspective view drawn on substantially the same scale as FIG. 9, illustrating the two pieces of the container of FIG. 9, separated and in position for attachment together for closing the container.
FIG. 11 is a perspective view, drawn on substantially the same scale as FIGS. 9 and 10, and showing the container in closed condition.
FIG. 14 is a perspective view drawn on substantially the same scale as FIGS. 9–11, and illustrating a plurality of the containers in stacked or nested condition, with the two pieces of the container separated.
Figure 12:
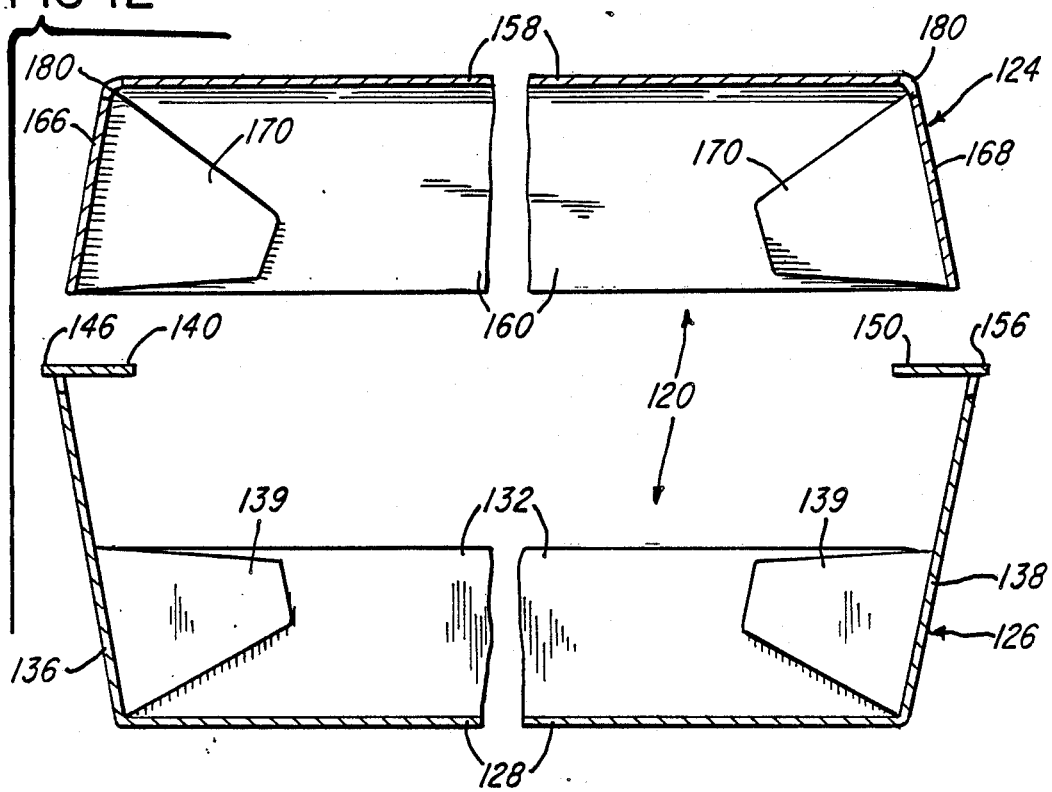
FIG. 12 is an enlarged sectional view, with parts broken away and shown in section, and taken substantially on line 12—12 of FIG. 10.
Figure 13:
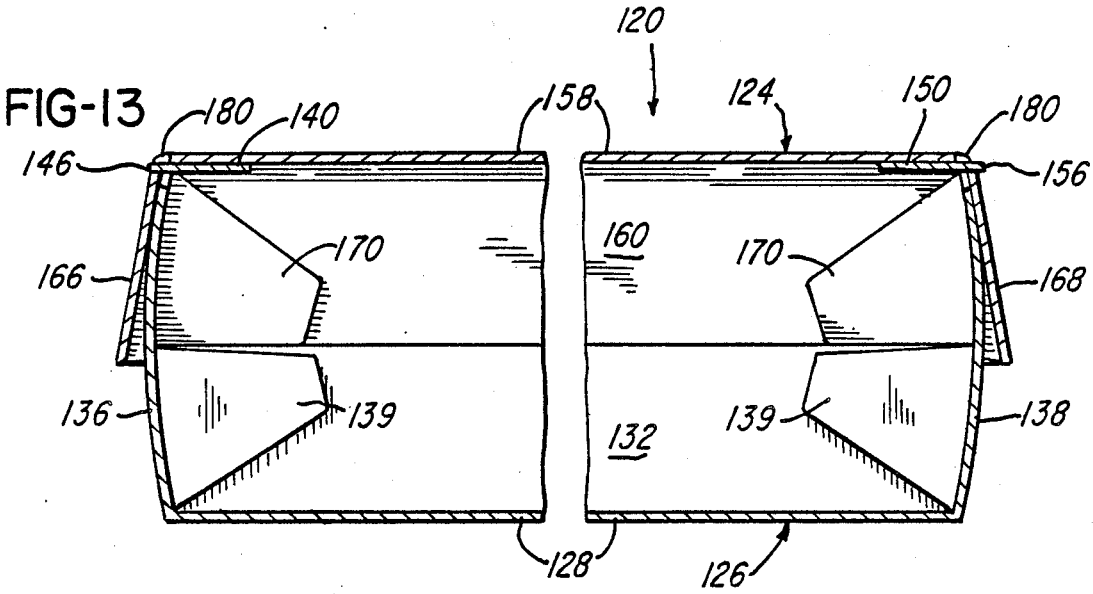
FIG. 13 is an enlarged sectional view, with parts broken away, and shown in section, and drawn on substantially the same scale as FIG. 12, and taken substantially on line 13—13 of FIG. 11.

When it is desired to close the two-piece container, the upper piece 124 is inverted from the position thereof shown in FIG. 9 and moved to the position shown in FIGS. 10 and 12, above the lower piece 126. Then the upper piece 124 is lowered into engagement with the lower piece 126, as illustrated in FIGS. 11 and 13. As the upper piece 124 is lowered toward the lower piece 126, the side walls 160 and 162 of the upper piece 124 engage the side walls 130 and 132 of the lower piece 126. The end walls 168 and 166 engage the end walls 138 and 136 of the lower piece 126. As the upper piece 124 is forced downwardly upon the lower piece 126, the latch 146 moves into the slot 180 of the upper piece 124, and the latch 156 moves into the slot 180 of the upper piece 124. When the latches 146 and 156 are within the slots 180, the flaps 140 and 150, which are integral with the latches 146 and 156 engage the upper panel 158, as shown in FIG. 13. Thus, the latches 146 and 156 are maintained within the slots 180. Thus, the upper piece 124 is firmly attached to the lower piece 126.

Thus, it is understood that the upper piece 124 comprises a cover member of the container 120 and the lower piece 126 comprises a body member of the container 120.

To remove the upper piece 124 from the lower piece 126, the end walls 166 and 168 are bent outwardly from the end walls 136 and 138 of the lower piece 126. Thus, the latches 146 and 156 are released from the slots 180 and the upper piece 124 can be removed from the lower piece 126.

As illustrated in FIG. 14, a plurality of the upper pieces 124 can be stacked or nested, and a plurality of the lower pieces 126 can be stacked or nested. This condition is possible in the upper piece 124 as a result of the angular relationship between the upper panel 158 and the walls 160, 162, 166, and 168. This condition is possible in the lower piece 126 as a result of the angular relationship between the lower panel 128 and the walls 130, 132, 136, and 138. This angular relationship in the upper piece 124 and the lower piece 126 is preferably in the order of about 98 to 108 degrees.

The two-piece container 120 of this invention is also preferably constructed of corrugated paper or paper-like material. Preferably, the corrugations are of the E-flute type. Preferably, the flutes or corrugations extend from the flap 140 to the flap 150 in the lower piece 126, and from the wall 166 to the wall 168 in the upper piece 124. Therefore, the two-piece container 120 has all of the characteristics and advantages of the one-piece container 20.

Although the preferred embodiments of the structure and method of this invention have been described, it will be understood that within the purview of this invention various changes may be made in the form, details, proportions, methods and arrangement of parts, the combination thereof, and the mode of use which generally stated consist in a structure and/or method within the scope of the appended claims.

The invention having thus been described, the following is claimed:

1. A container of semi-rigid paper-like material, comprising an upper panel, a lower panel, a first pair of side walls, the first pair of side walls being attached to the upper panel at opposite portions thereof, a pair of first end walls, the first end walls being attached to the upper panel at opposite portions thereof, there being an opening partially separating one of said first end walls from the upper panel, said opening being within said first end wall and within an adjacent part of the upper panel, the upper panel and said first end walls and said first side walls attached thereto forming a cover member of the container, a pair of second side walls, the second side walls being attached to the lower panel at opposite portions thereof, a pair of second end walls, the second end walls being attached to the lower panel at opposite portions thereof, one of said second end walls including a pivotal flap, the lower panel and said walls attached thereto forming a body member of the container, the upper panel being in covering relationship upon the lower panel as said side walls of the upper panel at least partially cover said side walls of the lower panel, said first end wall of the upper panel which has said opening therein covering said second end wall of the lower panel which includes said pivotal flap, said pivotal flap of said second end wall extending into said opening which partially separates said first end wall and said upper panel, whereby said flap within said opening latchably attaches said first end wall to said second end wall, whereby the cover member is latched in covering relationship to the body member of the container, said opening which partially separates the upper panel and said first end wall providing an aperture within which said flap can be readily pivotally moved for withdrawal of said flap from said opening and from said first end wall of the upper panel for unlatching the cover member from the body member of the container.

2. The container of claim 1 in which one of said first end walls is attached to one of said second end walls.

3. The container of claim 1 which includes means pivotally attaching one of the second end walls of the lower panel to said first end walls of the upper panel, whereby a one piece container is formed.

4. A two-piece carton, comprising a first piece of semi-rigid paper-like material, the first piece of semi-rigid paper-like material including a lower panel, a pair of lower side walls joined to the lower panel at opposite portions thereof, a pair of lower end walls joined to the lower panel at opposite portions thereof, a pair of latch members, each of said latch members being pivotally attached to one of the lower end walls and protruding therefrom, there being one of said latch members pivotally attached to each of said lower end walls, a second piece of semi-rigid paper-like material, the second piece including an upper panel, a pair of upper side walls joined to the upper panel at opposite portions thereof, a pair of upper end walls joined to the upper panel at opposite portions thereof, there being a pair of openings in said second piece, each of said openings partially separating one of said upper end walls from the upper panel, each of said openings having a portion within the upper panel and a portion within one of said adjacent end walls, the upper panel being positionable above the lower panel and substantially parallel thereto, with said second side walls at least partially covering said first side walls, and with said second end walls partially covering said first end walls, each latch member which is attached to one of said lower end walls being movable into one of said openings which partially separates an upper end wall from the upper panel, whereby each of said latch members which is within one of said openings latches the first piece to the second piece, each of said openings which partially separates one of said upper end walls from the upper panel forming a space within which said latch member therein is pivotally movable to remove said latch member from its respective opening for unlatching the first piece from the second piece.

5. The method of producing a container comprising forming semi-rigid foldable sheet material, including forming in the sheet material a first panel, forming a first end wall extending from the first panel, forming a first side wall extending from the first panel, forming a first tab extending from the first end wall, cutting out an edge portion of the first panel and cutting out an adjacent edge portion of said first end wall to form an opening between the first panel and said first end wall, forming in the sheet material a second panel, forming in the sheet material a second end wall extending from the second panel, forming in the sheet material a second side wall extending from the second panel, forming a second tab extending from said second end wall, forming a pivotal flap in said second end wall, pivotally moving said first end wall with respect to the first panel, pivotally moving said first tab with respect to said first end wall, pivotally moving said first side wall with respect to the first panel, attaching said first tab to said first side wall to position said first end wall and said first side wall at an angle with respect to the first panel, pivotally moving said second end wall with resepct to the second panel, pivotally moving said second tab with respect to the second end wall, pivotally moving the second side wall with respect to the second panel, attaching said second tab to said second side wall to position said second side wall and said second end wall at an angle with respect to the second panel, moving the first panel to a position substantially parallel with the second panel and placing said first end wall and said second end wall into juxtaposition with said first end wall at least partially covering said second end wall, whereby said flap of said second end wall moves into said opening which is between said first end wall and the first panel, whereby said flap of said second end wall which is within said opening in the first panel and said first end wall forms a latching condition between said second end wall and said first end wall and whereby the first panel and said second panel are latched together, said opening formed in the adjacent edge portions of the first panel and said first end wall providing a space whereby said flap can be readily pivotally moved and withdrawn from said opening and from said first end wall of the first panel for unlatching said first end wall from said second end wall and for unlatching said first panel from said the second panel.

6. The method of claim 5 in which the first panel and the first end wall of the sheet material are formed within a first foldable sheet member, and the second panel and the second end wall of the sheet material are formed within a second foldable sheet member, whereby the container is a two-piece container.

7. The method of claim 5 which includes forming the semi-rigid foldable sheet material into a single sheet member in which the first panel and the second panel and the first end wall and the second end wall are a part of the same sheet member and whereby the container is a one-piece container.

* * * * *